United States Patent [19]

Nishiyama

[11] Patent Number: 4,892,760

[45] Date of Patent: Jan. 9, 1990

[54] APPARATUS FOR SIMULTANEOUSLY COATING A PLURALITY OF SURFACE TYPE FASTENER TAPES OR LIKE STRIPS

[75] Inventor: Hissai Nishiyama, Toyama, Japan

[73] Assignee: Yoshida Koqyo K. K., Tokyo, Japan

[21] Appl. No.: 279,109

[22] Filed: Dec. 2, 1988

Related U.S. Application Data

[60] Continuation of Ser. No. 195,025, May 17, 1988, abandoned, which is a division of Ser. No. 928,480, Nov. 10, 1986, abandoned.

[30] Foreign Application Priority Data

Nov. 11, 1985 [JP] Japan ..... 60-172334

[51] Int. Cl.[4] ..... B05D 1/28; B05C 1/08

[52] U.S. Cl. ..... 427/428; 118/204; 118/235

[58] Field of Search ..... 118/204, 221, 222, 235; 427/428

[56] References Cited

U.S. PATENT DOCUMENTS 2,079,563 5/1937 Reuter ..... 118/204 X
2,754,796 7/1956 Faulkner, Jr. et al. ..... 118/204

FOREIGN PATENT DOCUMENTS 59-150561 8/1964 Japan .
59-228970 12/1964 Japan .
1349725 4/1974 United Kingdom .

*Primary Examiner*—Shrive Beck
*Assistant Examiner*—Alain Bashore
*Attorney, Agent, or Firm*—Hill, Van Santen, Steadman & Simpson

[57] ABSTRACT

An apparatus for applying a coating composition to one side of each of several surface type fastener tapes in order to establish the positive anchorage of interengageable hooks or loops on the other side of the tape. Included is a coating roller partly dipped in the coating liquid in an open top receptacle and extending across the fastener tapes traveling in parallel spaced relation to one another. Held against the surface of this coating roller, a doctor blade has several recesses defined in its scraping edge so as to be in register with the fastener tapes traveling in contact with the coating roller. Thus the doctor blade is effective to scrape off the coating liquid only from those parts of the coating roller surface which do not make contact with the fastener tapes, thereby precluding the possibility of the coating liquid from flowing over the selvages of the fastener tapes onto the other sides of the tapes carrying the hooks or loops.

7 Claims, 5 Drawing Sheets

APPARATUS FOR SIMULTANEOUSLY COATING A PLURALITY OF SURFACE TYPE FASTENER TAPES OR LIKE STRIPS

This is a continuation of application Ser. No. 195,025, filed May 17, 1988, which is a division of application Ser. No. 928,480, filed Nov. 10, 1986. both are now abandoned.

BACKGROUND OF THE INVENTION

This invention relates to a coating apparatus and more specifically to an apparatus for coating one side of a plurality of strips or tapes of fabrics, plastics or any other material at one time so as to prevent the coated substance from flowing onto the other sides of the strips. The coating apparatus of this invention is of particular utility when used for applying a coating substance to the rear sides of elongate surface type fastener tapes having a multiplicity of hooks or loops on their front sides, in order to firmly anchor such hooks or loops to their carrier fabric.

The surface type fastener is known which comprises one fastener member having a mulplicity of hooks on a piece of carrier fabric, and another fastener member having a multiplicity of loops on another piece of carrier fabric. When pressed against each other, the two fastener members fasten together as a result of the interengagement of the hooks and loops. The hooks and loops are disengageable when the fastener members are forced apart from each other. In the manufacture of such surface type fasteners, fastener tapes are prepared which are elongate strips of carrier fabric each having hooks or loops on its front side. The rear sides of these fastener tapes must be coated with a liquid which, when cured, can provide a positive anchorage for the hooks or loops onto the carrier fabric.

The usual practice in the fastener industry for coating the rear sides of the fastener tapes has been to feed a plurality or multiplicity of such fastener tapes in coplanar, parallel spaced relation to one another over a coating roller partly dipped in a coating agent contained in a pan or any other open top vessel (as will be later explained with reference to FIG. 8 of the drawings attached hereto). However, if applied to the fastener tapes from the complete surface of the coating roller, the coating agent will readily permeate the longitudinal edge portions of the fastener tapes, where they have no hooks or loops, and will thoroughly cover the selvages of the fastener tapes which need not be coated.

So coated, the selvages of the fastener tapes will harden upon curing of the coated liquid. Surface type fasteners are usually attached to desired articles by stitching the selvages thereto. The selvages hardened by excessive coating as above make this stitching difficult and so impair the commercial value of the fasteners.

Japanese Laid Open Patent Application No. 59-228970 and Japanese Laid Open Utility Model Application No. 59-150561 suggest a solution to this problem, both teaching the creation of a plurality of circumferential channels in the surface of a coating roller partly dipped in a desired coating liquid. As the strips to be coated are fed in rolling engagement with the channeled coating roller, the liquid is applied to the strips from the channels.

An objection to this known apparatus is that the thickness and width of the coatings on the strips are determined by the depth and width of the channels in the coating roller. Consequently, many coating rollers having different numbers, widths and depths of channels must be manufactured and held in stock for coating different numbers and widths of strips to different thicknesses. This conventional coating apparatus is therefore not adaptable for a variety of applications without necessitating much cost for the manufacture of many differently channeled coating rollers which are very expensive.

SUMMARY OF THE INVENTION

The present invention provides an improved coating method whereby a desired coating agent can be applied only to one side of each of a plurality or multiplicity of surface type fastener tapes or other strips, without the possibility of the coating agent flowing onto the other sides of the strips. The improved method of this invention is notable for its ready adaptability for a variety of specific coating applications and requirements at reduced cost.

Briefly, the invention may be summarized as a coating method for simultaneously applying a desired coating substance to a plurality of surface type fastener tapes or like strips, each having a known width, traveling in a predetermined direction along a predetermined path in parallel relation to each other and with a predetermined spacing therebetween. The coating method uses a coating roller disposed across the predetermined path of the strips so as to be in coating contact therewith. A supply means is provided for constantly supplying the coating substance over the surface of the coating roller. Also included is a doctor blade having a scraping edge held against the surface of the coating roller for selectively scraping off the coating substance therefrom. The scraping edge of the doctor blade has defined therein a series of recesses each having a length approximately equal to the width of each strip, the recesses having a spacing therebetween which is approximately equal to the spacing between the strips being coated.

Preferably, the supply means takes the form of an open top vessel containing the coating liquid, in which the coating roller is partly dipped, so that the coating liquid is applied to the surface of the coating roller throughout its axial length. The doctor blade with its recessed scraping edge operates to scrape off the liquid from those surface portions of the coating roller which do not make contact with the strips. The recesses in the scraping edge leave the coating liquid on the coating roller in the shape of bands which are each of approximately the same width as each strip and which have approximately the same spacing therebetween as that between the strips. Travelling in contact with these bands of the coating liquid, the strips have only their required sides coated with the liquid. There is practically no likelihood of the coating substance intruding onto the other sides of the strips over their longitudinal edges, because only a required amount of the substance is applied to each strip from a required surface portion of the coating roller.

The selective doctoring of the coating agent off the coating roller in accordance with the invention offers an additional advantage. Should the coating substance be left unscraped from the unrequired surface portions of the coating roller, the substance on these unrequired surface portions would be denatured through overexposure to the atmosphere. The denatured substance would then return to the vessel, thereby accelerating the denaturation of the complete substance within the vessel.

The present invention precludes this danger and extends the useful life of the coating substance.

The recesses in the scraping edge of the doctor blade may each be either rectangular or arcuate in shape. Alternatively, the doctor blade edges defining the recesses may be sawtoothed for use with a coating agent of relatively low viscosity. It is also possible to truncate the sawteeth for use with a coating agent of still lower viscosity. Many doctor blades having recesses of such various shapes and depths may be prepared to regulate the amounts of the liquid to be left on the coating roller and hence to be coated on the strips. Thus the liquid will be applied to the strips in an optimum manner determined in part by its viscosity.

Doctor blades having the recesses of various lengths may also be prepared for coating strips of various widths. Although the coating method of this invention requires the use of many interchangeable doctor blades for adaptability of different applications and applications, such doctor blades are far less costly than the interchangeable coating rollers required by the prior art set forth previously.

The above and other features and advantages of this invention and the manner of realizing them will become more apparent, and the invention itself will best be understood, from a study of the following description and appended claims, with reference had to the attached drawings showing some preferably embodiments of the invention.

DESCRIPTION OF THE PREFERRED EMBODIMENTS

Figure 1:
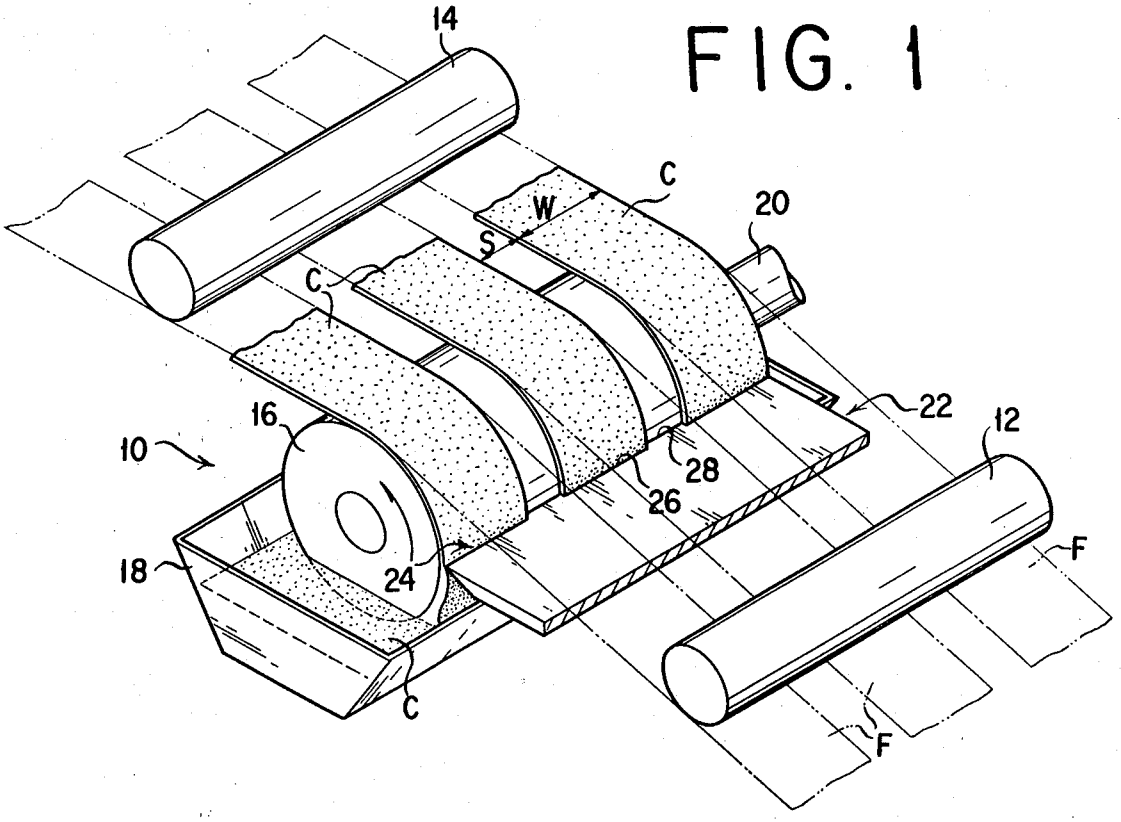
FIG. 1 is a diagrammatic perspective view, partly shown broken away for illustrative convenience, of the coating apparatus used in accordance with the novel concepts of this invention.

The coating method of this invention will now be described in detail as adapted, by way of example only, for simultaneously coating three surface type fastener tapes. The representative coating apparatus is generally designated 10 in FIGS. 1 and 2. As will be seen from these figures, the three fastener tapes F to be coated travel in a predetermined direction, from right to left in FIGS. 1 and 2, along a predetermined path in parallel spaced relation to one another. Extending across the path of the fastener tapes F and spaced from each other in the longitudinal direction of the path, two guide rollers 12 and 14 are shown guiding such travel of the fastener tapes. The fastener tapes F have each a known width W and are spaced a predetermined distance S from one another.

The coating apparatus 10 includes a coating roller 16 disposed horizontally across the predetermined path of the fastener tapes F in coating engagement with the undersides of the fastener tapes. It is understood that the fastener tapes F travel with their front sides directed upwardly, so that the rear sides of these fastener tapes are to be coated in a manner set forth hereafter.

Any known or suitable coating liquid is to be supplied to the surface of the coating roller 16 throughout its axial dimension. Toward this end the coating roller 16 is shown partly dipped in a coating liquid C contained in a pan or open top vessel 18. Mounted on a rotary shaft 20 extending axially therethrough, the coating roller 16 rotates in a counterclockwise direction as viewed in FIGS. 1 and 2.

Figure 2:
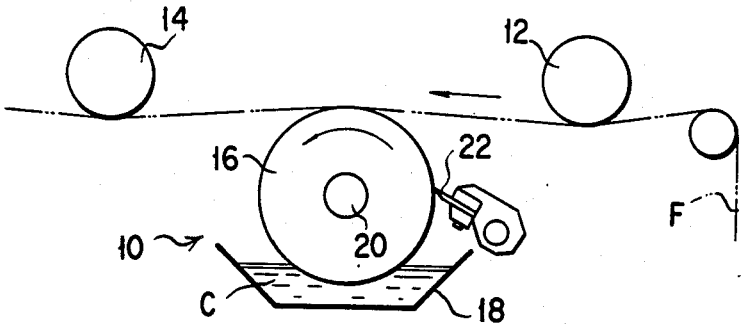
FIG. 2 is a diagrammatic side elevation of the coating apparatus of FIG. 1.

At 22 in both FIGS. 1 and 2 is shown a doctor blade having a scraping edge 24 held against the surface of the coating roller 16 for selectively scraping off the coating liquid C therefrom in accordance with the principles of this invention. FIG. 2 indicates that the doctor blade 22 is so angled with respect to a radial direction of the coating roller 16, and in relation to the predetermined rotational direction of the coating roller, as not to scratch or otherwise ruin the surface of the coating roller.

Figure 3:
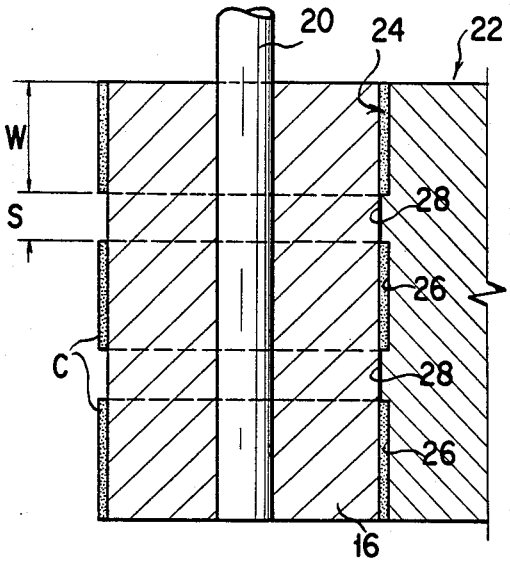
FIG. 3 is an enlarged axial section through the coating roller in the coating apparatus of FIG. 1, shown together with part of the doctor blade having the recessed scraping edge held against the coating roller.

As better illustrated on an enlarged scale in FIG. 3, the scraping edge 24 of the doctor blade 22 has defined therein a plurality of, three in this particular embodiment, recesses 26 arranged at constant spacings in the longitudinal direction of the scraping edge. Each recess 26 is rectangular in shape in this particular embodiment and has a length (i.e., the dimension in the longitudinal direction of the scraping edge 24) approximately equal to the width W of each fastener tape F to be coated. The recesses 26 are spaced from each other the same distance S as are the fastener tapes F. Thus the doctor blade 22 selectively scrapes the coating liquid C off the coating roller 22 only with the relatively protuberant parts 28 of its scraping edge 24 left between the recesses 26.

Operation

Guided by the guide rollers 12 and 14, the fastener tapes F travel at a consant speed in contact with the coating roller 16 which is revolving in partial immersion in the liquid C within the open top vessel 18. The doctor blade 22 operates to selectively scrape the liquid C off the successive circumferential parts of the coating roller 16 before such parts come into contact with the fastener tapes F. As will be seen from FIG. 3, only the relatively protuberant parts 28 of the scraping edge 24 scrape off the liquid, whereas the recesses 26 in the scraping edge leave the liquid in the form of bands on the coating roller 16. These bands of the coating liquid C left on the coating roller 16 are each of substantially the same width as each fastener tape F and are in register with the respective fastener tapes. Thus the fastener tapes F travel in contact with the bands of the coating liquid C left unscraped on the coating roller 16 and so have their rear sides coated with the liquid.

Figure 4:
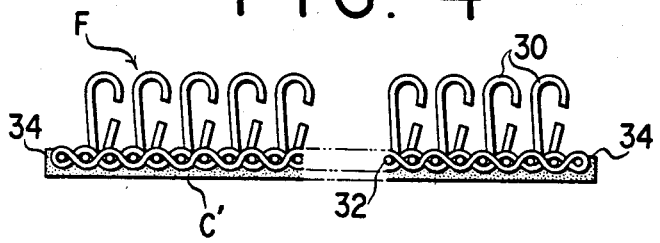
FIG. 4 is an enlarged transverse section, shown partly broken away for illustrative convenience, through one of the fastener tapes coated by the apparatus of FIG. 1.

FIG. 4 illustrates the fastener tape F having the coating C' formed on its rear side by the coating apparatus 10 of FIGS. 1 and 2. The coating C' is effective to hold the hooks 30 against detachment from the carrier fabric 32. It will be seen that the coating C' covers only the rear side of the fastener tape F, without any overflow onto its front side over the selvages 34.

As will be seen by referring back to FIG. 3, the thickness 7 of the bands of the coating liquid C left unscraped on the coating roller 16, and therefore of the coatings C' formed on the fastener tapes F, depends upon the depth of the recesses 26 in the scraping edge 24 of the doctor blade 22. Any required number of interchangeable doctor blades may therefore be prepared which have the recesses 26 of varying depths, and these doctor blades may be selectively employed to create the coatings C' of required thickness on fastener tapes.

There may also be prepared a suitable stock of interchangeable doctor blades having the recesses 26 of different lengths. Then the coating apparatus 10 will be readily adaptable for coating fastener tapes or other strips of various widths.

Alternative Forms

The doctor blade for use in the coating method of this invention can be recessed in various ways other than that shown in FIG. 3, in order to adapt the apparatus for use with coating substances of various viscosities and for the specific requirements of each application.

Figure 5:
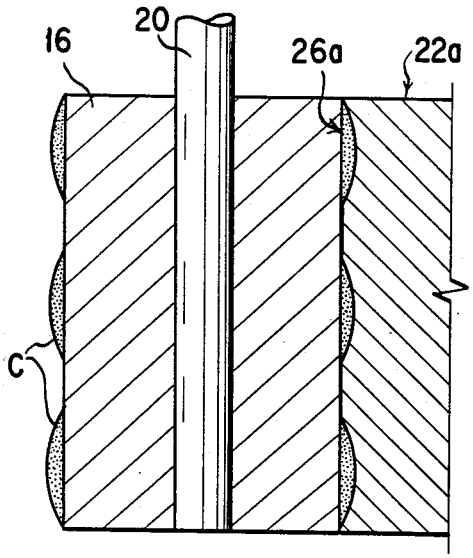
FIG. 5 is a view similar to FIG. 3 but showing a modified doctor blade.

FIG. 5 shows a modified doctor blade **22*a* having a series of recesses 26*a* which are arcuate or concave in shape, instead of being rectangular as in the embodiment of FIG. 3. These arcuate recesses 26*a* result in the creation of convex bands of coating liquid C on the coating roller 16**, each band becoming thinner toward its opposite lateral edges. Consequently, when fastener tapes or other strips are held against this coating roller, there is still less possibility of the coating liquid flowing onto their front sides.

Figure 6:
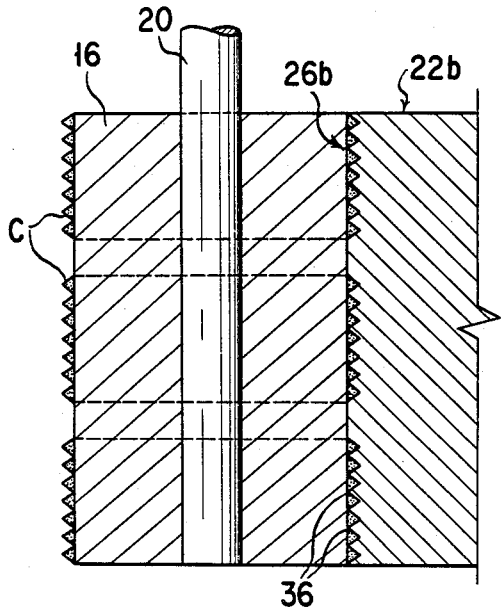
FIG. 6 is also a view similar to FIG. 3 but showing another modified doctor blade.

In another modified doctor blade **22*b* shown in FIG. 6, each recess 26b is defined by a sawtoothed edge of the doctor blade. The sawtoothed edge of the doctor blade 22*b* has a series of pointed sawteeth 36. This doctor blade 22*b* leaves the coating liquid C in the shape of sawteeth on the coating roller 16**. If the liquid is of appropriately low viscosity, it will create a nearly flat coating on one side of a fastener tape or the like without flowing onto the other side thereof.

Figure 7:
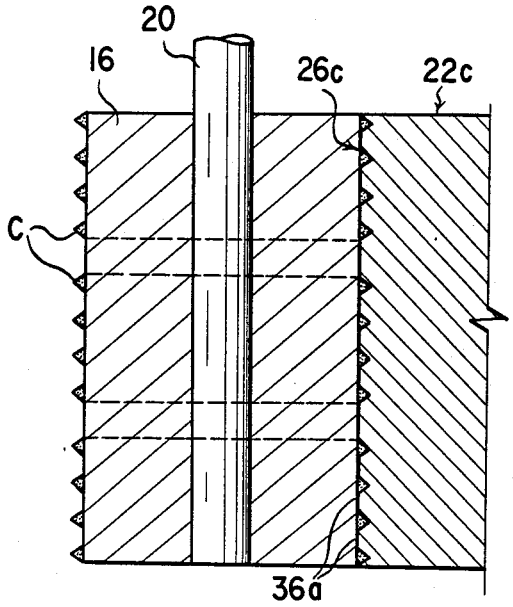
FIG. 7 is also a view similar to FIG. 3 but showing still another modified doctor blade.

Still another modified doctor blade **22*c* of FIG. 7 has each of its recesses 26*c* also defined by a sawtoothed edge. The sawtoothed edge of this doctor blade 22*c*, however, has a series of truncated sawteeth 36*a*. As a result, the doctor blade 22*c* leaves the coating liquid C in the shape of spaced apart sawteeth on the coating roller 16. This doctor blade is therefore suitable for use with a coating liquid of still lower viscosity than that of the liquid used with the doctor blade 22*b* of FIG. 6**.

Figure 8:
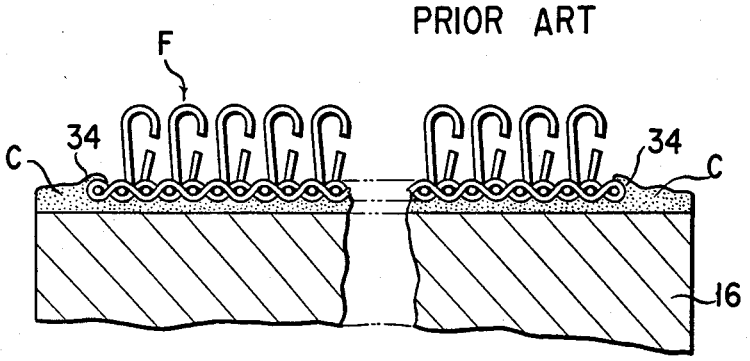
FIG. 8 PRIOR ART
FIG. 8 is a fragmentary axial section through a prior art coating roller shown together with fastener tapes being coated.

FIG. 8 shows the aforementioned prior art coating roller 38 having no recessed doctor blade taught by the present invention. Since the prior art roller 38 has its complete surface covered with the coating agent C as it makes coating contact with the fastener tapes F, the excess amounts of the coating agent have been easy to flow onto the front side of the fastener tapes over their selvages 34, resulting in the difficulties pointed out previously. The present invention eliminates such difficulties by the means set forth in detail hereinbefore.

Although it has already been mentioned, it must be borne in mind that the fastener tape coating apparatus herein disclosed has been chosen with the thought of pictorially presenting the principles of the present invention in conjunction with the resulting advantages gained in this particular application. Thus the illustrated apparatus may be modified or altered within the scope of the invention to conform to design preferences or to the specific requirements of each intended application.

What is claimed is:

1. A method for simultaneously applying a coating substance to a plurality of elongated tapes each of a known width which comprises:

moving said tapes in uniformly spaced relation along a predetermined path in parallel spaced relation;

applying a layer of coating subatance uniformly across the surface of a coating roller, contacting said layer while on said roller with a doctor blade having scraping edges registering with the spacings between said tapes and recesses between said scraping edges equal to the widths of said tapes, and removing coating substance from said roller with said scraping edges while depositing coating substances on said moving tapes limited to the widths of said tapes.

2. A method according to claim 1 wherein said doctor blade has projections between said recesses to define the lateral edges of the adjacent deposits of coating substances.

3. A method according to claim 1 wherein said recesses are rectangular in shape.

4. A method according to claim 1 wherein said recesses are arcuate in shape.

5. A method according to claim 1 wherein said doctor blade has a sawtoothed edge defining each recess.

6. A method according to claim 5 wherein said sawtoothed edge of the doctor blade has a series of pointed sawteeth.

7. A method according to claim 5 wherein each sawtoothed edge of the doctor blade has a series of truncated sawteeth.

* * * * *